US009677866B2

(12) United States Patent
Perrin et al.

(10) Patent No.: US 9,677,866 B2
(45) Date of Patent: Jun. 13, 2017

(54) ATTACHMENT/RELEASE DEVICE AND ASSEMBLIES AND SYSTEMS USING SAME

(75) Inventors: Kim Perrin, Dorchester (GB); Roy Jones, Dorchester (GB)

(73) Assignee: ECS Special Projects Limited, Dorset (GB)

( * ) Notice: Subject to any disclaimer, the term of this patent is extended or adjusted under 35 U.S.C. 154(b) by 332 days.

(21) Appl. No.: 13/825,512

(22) PCT Filed: Aug. 15, 2011

(86) PCT No.: PCT/GB2011/051541

§ 371 (c)(1),
(2), (4) Date: Mar. 21, 2013

(87) PCT Pub. No.: WO2012/038711

PCT Pub. Date: Mar. 29, 2012

(65) Prior Publication Data

US 2013/0199358 A1 Aug. 8, 2013
US 2014/0083282 A9 Mar. 27, 2014

(30) Foreign Application Priority Data

Sep. 21, 2010 (GB) ..... 1015812.9

(51) Int. Cl.
*F42D 5/04* (2006.01)
*B63G 7/02* (2006.01)
*B63G 7/00* (2006.01)

(52) U.S. Cl.
CPC ..... *F42D 5/04* (2013.01); *B63G 7/02* (2013.01); *B63G 2007/005* (2013.01)

(58) Field of Classification Search
CPC .... F42D 5/04; B63G 7/00; B63G 7/02; B63G 2007/005

(Continued)

(56) References Cited

U.S. PATENT DOCUMENTS 1,365,869 A 1/1921 Temple
2,819,674 A * 1/1958 Prodanovich ..... F41C 9/06 102/371

(Continued)

FOREIGN PATENT DOCUMENTS

| | | |
|---|---|---|
| EP | 2415660 | 2/2012 |
| GB | 2234203 A | 1/1991 |
| GB | 2251785 A | 7/1992 |

OTHER PUBLICATIONS

Clifford Funnell and Charles Hollosi, "Jane's Underwater Warfare Systems 2010-2011," Twenty-second Edition, Jun. 28, 2010.

(Continued)

*Primary Examiner* — James S Bergin
(74) *Attorney, Agent, or Firm* — Pearl Cohen Zedek Latzer Baratz LLP

(57) ABSTRACT

An impact initiated attachment device for attachment to a target, comprises a housing having a front face which abuts against the target in use, one or more fasteners, a drive mechanism for driving the fasteners(s) from a first position within the housing to a second position protruding from the front face of the housing, and a trigger mechanism for triggering activation of the drive mechanism comprising a trigger extending from the front face of the housing. The device is particularly useful in Explosive Ordnance Disposal (EOD) and demolition for attaching one or more disrupters to a target for disposal.

30 Claims, 19 Drawing Sheets

(58) Field of Classification Search
USPC ..... 102/402, 403; 89/1.13; 86/50; 114/21.1, 21.2
See application file for complete search history.

(56) References Cited

U.S. PATENT DOCUMENTS

| | | | | | |
|---|---|---|---|---|---|
| 3,013,517 | A * | 12/1961 | Isham | B63B 21/54 | 114/221 R |
| 3,554,424 | A * | 1/1971 | Newton | B25C 1/087 | 227/8 |
| 3,565,312 | A * | 2/1971 | Temple | B25C 1/18 | 227/9 |
| 3,880,103 | A * | 4/1975 | Talkington | 405/185 | |
| 4,696,234 | A | 9/1987 | Kaltmann et al. | | |
| 4,970,957 | A | 11/1990 | Backstein et al. | | |
| 5,042,387 | A * | 8/1991 | Backstein | 102/402 | |
| 5,425,488 | A * | 6/1995 | Thompson | B25C 1/14 | 227/10 |
| 5,831,199 | A | 11/1998 | McNulty, Jr. et al. | | |
| 5,943,806 | A * | 8/1999 | Underwood | A01K 81/00 | 102/371 |
| 6,453,788 | B1 | 9/2002 | Lebet et al. | | |
| 8,297,162 | B2 * | 10/2012 | Fournier | 89/1.13 | |
| 8,807,002 | B2 * | 8/2014 | Lambertus | 89/1.13 | |
| 2008/0087186 | A1 * | 4/2008 | Blohm et al. | 102/403 | |

OTHER PUBLICATIONS

U.S Navy, "Mine Warfare," Department of the Navy Naval Doctrine Command, Aug. 1996 (Chapters 1-4).

Anthony J Watts, "Jane's Underwater Warfare Systems," Thirteenth Edition 2000-2001, Virgina, USA (pp. 243-244, 267-394).

D Beatie, "A shaped charge weapon for mine disposal," Conference Proceedings, Jun. 15-17, 1993, (pp. 396-397) Palais des Festivals et des Congres, Cannes, France.

British Aerospace Defence Systems, "SeaSting," Jun. 16, 1999, United Kingdom.

Keith Simpson,Wembley Conference Centre, "Shaped charge mine disposal system," Jul. 2-4, 1996, (pp. 309-311) London, UK.

Robert D. Christ, "ROV Manual—A User Guide for Observation-Class Remotely Operated Vehicles," Oct. 4, 2011 (pp. 11-45, 46-80, 162-192, 219-228).

W.P Walters and J.A. Zukas, "Fundamentals of Shaped Charges," 1989, (pp. 1-31, 328-390).

Anthony J Watts, "Jane's Underwater Warfare Systems," Twelfth Edition 2000-2001, Virgina, USA.

BAE Systems, "SeaSting Shaped Charged Mine Disposal System," Jun. 8, 2000 (pp. 2-3).

BAeSEMA, "Mine Countermeasure Systems," Published before Sep. 21, 2010 (pp. 1-13).

* cited by examiner

ATTACHMENT/RELEASE DEVICE AND ASSEMBLIES AND SYSTEMS USING SAME

CROSS-REFERENCE TO RELATED APPLICATIONS

This application is the United States National Phase of PCT Patent Application No. PCT/GB2011/051541 filed on 15 Aug. 2011, which claims priority to British Patent Application No. 1015812.9 filed 21 Sep. 2010, both of which are incorporated herein by reference.

The present invention relates generally to an impact initiated attachment device and assemblies and systems using the same. The device has been developed for use in Explosive Ordnance Disposal (EOD) and demolition principally but not exclusively in a marine environment. However the device itself has numerous other applications. The device is particularly useful in the attachment of a disrupting explosive charge to ordnance for disposal. In the case that the disrupting explosive charge is carried on a vehicle that it is desired to re-use, the same device may be used to releasably fasten the vehicle to the disruptor. Thus the present invention also relates to releasable fastenings.

BACKGROUND

One method for clearing seaways of historic ordnance is to survey the area using either divers or a Remotely Operated Vehicle (ROV) to locate the ordnance and then use divers to attach explosive packs (referred to below as disruptors) to countermine and destroy a target. On floating and drifting mines, this can be hazardous and difficult to achieve particularly in adverse sea conditions. ROVs are also used to place a countermining charge close to the ordnance to induce a sympathetic detonation of the target. Due to the change of explosive fillings in more modern mines and ordnance, the effectiveness of the countermining charge has been questioned due to its ineffectiveness in generating a high order detonation. The use of shaped charges has become preferred. A shaped charge is most effective when positioned at the optimum stand-off distance from the target. It is the positioning and fixing of the shaped charge which has been a capability gap in some fields.

GENERAL

In one aspect there is provided in the following an impact initiated attachment device for attachment to an target, the device comprising: a housing having a front face which abuts against the target in use, one or more fasteners, a drive mechanism for driving the fastener(s) from a first position within the housing to a second position protruding from the front face of the housing, and a trigger mechanism for triggering activation of the drive mechanism comprising a trigger extending from the front face of the housing.

Because the trigger extends from the front face of the housing, all that is required to activate the drive mechanism is to press the device onto the surface of the target whereby to press the trigger. It is therefore very simple to operate since the user does not have to place the device and then fire it, which might be particularly difficult in an underwater environment. The user can concentrate on the positioning of the device and simply has to apply some additional pressure to activate the drive mechanism.

The drive mechanism may be arranged to detonate a cartridge containing explosive material to cause the fastener to be driven to the second position. It may include a striker within the housing which is forced in a direction towards the front face in response to pressure on the trigger from outside the housing towards the front face. The striker may be arranged to strike the cartridge and thereby detonate the explosive.

The fastener or fasteners may be nails. Other suitable fasteners include hooks and harpoon-type devices. Preferably the fastener has a pointed forward end to penetrate the surface of the target.

Each fastener is preferably an elongate member having a laterally extending rear portion which is captured within the housing when the fastener is in the second position. For example, each fastener may have a generally cylindrical forward portion and the laterally extending portion may provide an annular shoulder to abut against a portion of the interior of the housing. The laterally extending portion may be in the form of a piston.

A line such as a bungee or other elastic cord may be attached to the housing arranged to be released from the housing on activation of the drive mechanism. This is particularly useful when carrying the device underwater. The line may be used to attach the device to a vehicle for example so that the vehicle is released when the attachment device has been activated.

Another aspect of the invention relates to the releasable fastening which may be used without attachment of the device to the target.

In another aspect there is provided in the following a releasable fastening device comprising:

a housing;

a fastening mechanism comprising a movable member for fastening one or more items to the housing, the fastening mechanism having open and closed configurations; and a trigger protruding from the housing;

wherein the activation of the trigger by pressure towards the housing causes the movable member to move from a first position in which the fastening mechanism is in the closed configuration to a second position in which the fastening mechanism is in the open configuration.

As will be described in more detail below, any of the devices described above may be assembled with one or more disruptors.

Thus, one possible application of the releasable fastening device would be to attach an ROV to a disruptor device containing the countermining charge, use the ROV to place the disruptor close to the ordnance and then release the ROV before inducing a sympathetic detonation of the target. The ROV would simply have to drive the releasable fastening device towards a solid surface on or near to the target to press the trigger which would then release the ROV.

In the releasable fastening device the trigger may protrude from a front face of the housing.

In the preferred embodiment of releasable fastener, in the closed configuration the member bridges an opening in the housing and in the open configuration the member is at least partially retracted from the opening. The member may comprise a bolt. Thus when the bolt bridges the opening it can be used to fasten a loop of cable or other line to the device.

The device is preferably configured such that movement of the trigger in one direction causes the movable member to move in the opposite direction.

The releasable fastening device may comprise one or more fasteners, in addition to the fastening mechanism, for attaching the device to the surface of a target. The one or more additional fasteners may comprise one or more magnets. The one or more additional fasteners may be arranged in the same face of the device as the trigger.

In another preferred embodiment, the trigger itself is configured to fasten the device to the surface of a target. In that case it is preferred for the trigger to comprise a stop for limiting its travel towards the housing. The trigger may have a shaped configured to resist its removal from an object after insertion, such as a harpoon shape.

The main purpose of the attachment device is to attach a secondary device such as a disruptor to a target. Therefore there is also provided in the following an assembly comprising one or more attachment devices and/or one or more releasable fastening devices as described above to which is attached one or more secondary devices for attachment to a target. The assembly may comprise a handle joining a device and a secondary device.

Each disruptor used in the assembly preferably has a generally cone shaped forward section. In the assembly the forward section is fixed with respect to an attachment device(s) and/or releasable fastening device(s) such that the trigger of the attachment device is level with or slightly forward of the front of the cone-shaped section of the disruptor(s). Each disruptor will typically also have a rear chamber for receiving explosive material.

The assembly may comprise a chassis to which the attachment device and one or more disruptors are attached. The chassis may comprise a collar or cowl or hood. This is particularly suitable for use with a submersible vehicle. The cowl or collar may be designed to fit over the nose of the vehicle so that the assembly can be guided by the vehicle. The assembly may comprise multiple disruptors arranged in parallel around the collar or cowl.

There is also provided a disruption system comprising an assembly as described above having one or more attachment devices and/or one or more releasable fastening devices and one or more disruptors. The system may also comprise a detonation line for attachment to the or each disruptor.

The system may comprise a dispenser for the detonation line and, for use on water, may also comprise a floating device for supporting the dispenser. The preferred form of detonation line is a plastic tube filled with explosive of the kind well known in the art of demolition.

It should be noted that other forms of remote initiation of the one or more disruptors may be used instead of the detonation line. One possibility is the use of an acoustic, i.e. sonar link between the remote location and the one or more disruptors.

It should be noted that one or more disruptors can be attached to a target using the attachment device whilst the detonation system is inert. The disruptor(s) can be placed with the detonation line attached. The connection of a detonation line to a detonation initiator may be deferred until the diver or placement vehicle has retreated. Furthermore the detonation initiator is preferably remotely operable so that personnel are at a safe distance before detonation.

Each disruptor is preferably in the form of a directional disruptive explosive charge device comprising a generally conical hollow forward section and a rear chamber for receiving explosive material, wherein the rear chamber comprises a cap which is removable to enable filling of the chamber. The rear interior surface of the chamber preferably has a rearward facing conical shape which may be provided in the removable cap. The forward interior surface of the chamber preferably has a rearward facing conical shape. The forward interior surface of the chamber is designed to be deformed when explosive material in the chamber is detonated.

DETAILED DESCRIPTION

Embodiments of the invention will now be described by way of example only and with reference to the accompanying drawings in which:

FIG. 1*a* is a schematic diagram illustrating attachment of a disruptor to a target using a hand held carrier;

FIG. 1*b* is a schematic diagram illustrating attachment of one or more disruptors to a target using a remotely operated vehicle;

FIG. 2*a* illustrates the main components of the attachment device or grappler;

FIG. 2*b* is a cross sectional view of the grappler barrel housing assembly;

FIG. 2*c* is a cross sectional view of the grappler barrel housing assembly showing an alternative trigger configuration to the one shown in FIG. 2*b;*

FIG. 2*d* is a cross sectional view of the breech assembly of the grappler ready for arming;

FIG. 2*e* is a cross sectional view of the breech assembly of the grappler armed;

FIG. 2*f* is a cross sectional view of the assembled grappler in the armed condition;

FIG. 2*g* is a cross sectional view of the assembled grappler after firing;

FIG. 3*a* illustrates the main components of the disruptor;

FIG. 3*b* is a cross sectional view of the charge cap assembly of the disruptor;

FIG. 3*c* is a cross sectional view of the front section of the disruptor;

FIG. 4*a* shows an assembly of a disruptor and a grappler configured for hand held deployment;

FIG. 4*b* shows the handle of FIG. 4*a* in more detail;

FIG. 5*a* is a top plan view of a cowl for use with an remotely operated vehicle (ROV).

FIG. 5*b* is an underside view of the cowl of FIG. 5*a;*

FIG. 5*c* is an underside view of the cowl unattached;

OVERVIEW OF TYPICAL OPERATION

Hand-Held Deployment

Figure 1A:
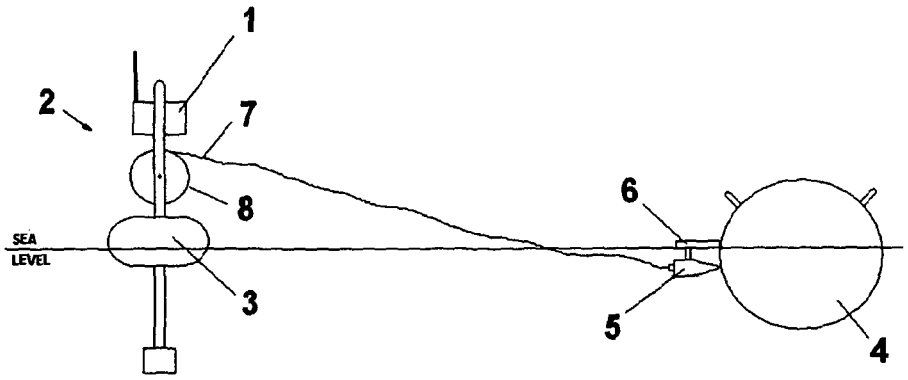
Figure 1B:
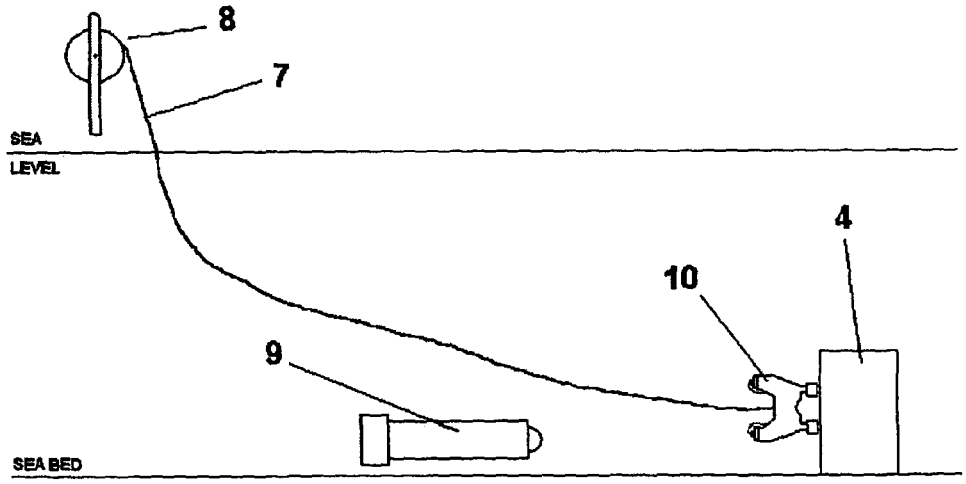

FIG. 1 illustrates deployment of a Disruptor 5 in a hand held configuration on a floating target 4.

When ready a Surface Initiation Float Unit indicated generally by reference numeral 2 is released from a boat, helicopter or other vehicle. The Surface Initiation Float Unit 2 comprises float 3, detonator initiation system 1, and tube dispenser reel 8. A swimmer/diver then enters the water and makes his way to the vicinity of the target 4.

When within 5 meters of the target, the swimmer/diver releases a hand held assembly or unit comprising an impact initiated attachment device, referred to in the following as a grappler 6, and disruptor 5 from a restraint on the Surface Initiation Float Unit 2 and approaches the target 4. A plastic tube 7 dispensed from a reel 8 on unit 2 is attached to the hand held unit. When within reach of the target the Grappler 6 is pressed onto a convenient place on the target 4. The Grappler 6 will then secure the Disruptor 5 on the target 4 in the one single action as will be explained in more detail below.

The swimmer/diver then returns to the Float 3 and swims down drift to open the range from the float 3 and the target 4.

When at the required safe range, the swimmer/diver then connects the proprietary plastic tube 7 to the detonator initiation system 1. The tube is filled with explosive powder used in the initiation of detonation. Notably the tube 7 is not connected to the initiator 1 and therefore the disruptor 5 is not armed until the swimmer is at a safe range from the target 4. Furthermore if there is any problem with the attachment of the tube it can be abandoned safely in the water—the explosive powder will simply disperse in the water without risk of explosion.

The swimmer/diver then returns to the vehicle.

The target 4 can then safely be disposed of by remote activation of the detonation initiator system 1.

On completion the Surface Initiation Float Unit 2 can be recovered and re-used.

ROV Deployment

Alternatively, a shore or ship mounted dispenser 8 for the proprietary plastic tube initiation system 7 may be used and one or more impact initiated attachment devices (Grapplers) 6 and Disruptors 5 may be mounted in a Cowl or collar 10 mounted on an ROV 9 (or manned vehicle).

A typical operation using this set up would be to prepare an assembly comprising two Grapplers 6 and two Disruptors 5 mounted into a Cowl 10. This would then be fitted to a ROV or Sea Scooter using a Bungee Cord attachment which in turn is joined via Release Bolts on the Grapplers 6 to be described in more detail below.

The ROV 9 would then be launched and, using the ROV's on board equipment and cameras, the target 4 located.

Once the target 4 was confirmed the ROV 9 would be driven to impact the target 4 with the Grapplers 6. Upon impact the Grapplers 6 would simultaneously attach the Cowl 10 to the Target, irrespective if either or both Grapplers were triggered, and release the Cowl from the ROV 9, enabling it to retire to a safe distance.

When the ROV 9 is at a safe distance the Disruptors 5, which are usually configured to initiate simultaneously, can be fired using either a Hand Held Initiator or Remote Initiator or other system.

The spent plastic tube 7 from the initiation system 1 can be recovered and disposed of.

DETAILED DESCRIPTION OF MAIN COMPONENTS

Grappler

The Grappler 6 consists of a Barrel assembly 21, comprising a housing which may be produced from aluminium alloy and a Breech assembly 20, which may be produced from acetyl or other similar material. Both components 20 and 21 are preferably designed such that they are sealed to prevent water ingress and operate from 0 to 300 meters depth or more. Upon impact with a target, the front mounted trigger 22 is activated and the Grappler 6 is attached to the target 4 by means of one or more high-tensile nails 23, which are fired (and retained) using a proprietary powder actuated impact tool cartridge 24. The illustrated cartridge is a rim activated cartridge.

More specifically the Grappler 6 is an indirect acting tool that uses a retained piston 25 and captive nail 23 to transfer energy from a proprietary impact tool cartridge 24 to secure the grappler unit 6 to the desired target.

Figure 2A:
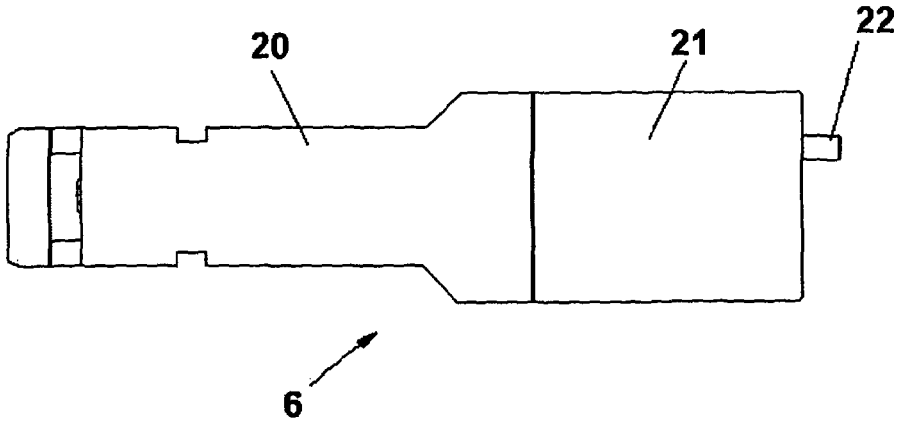
Figure 2B:
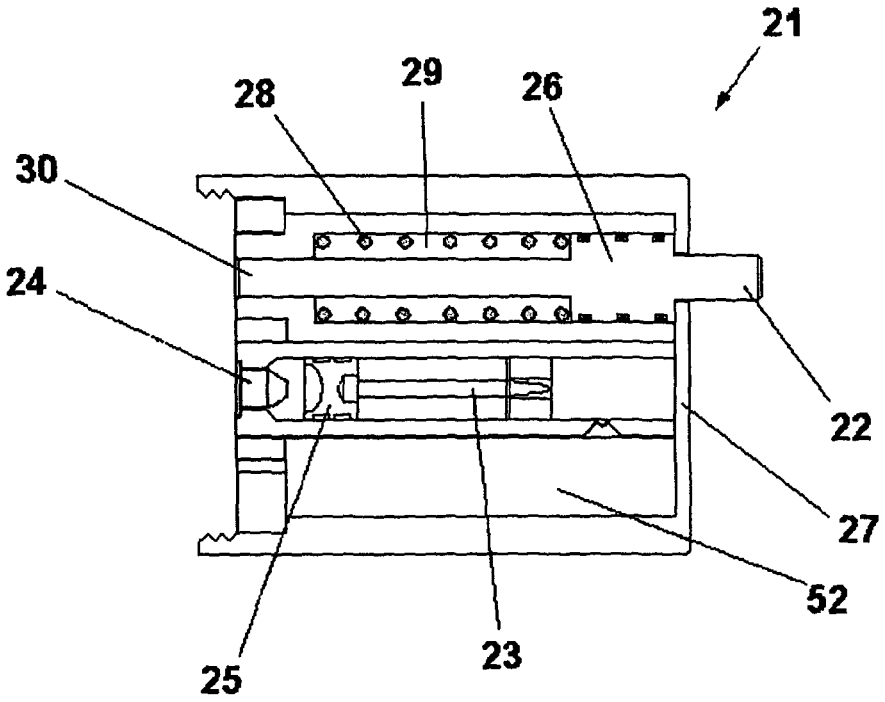

Contained in the Barrel Assembly 21 is the Trigger mechanism, which ultimately fires the Grappler 6. The trigger 22 is designed such that it is sealed to prevent water ingress into the housing. The trigger itself is a simple protrusion extending through a hole in the front wall 27 of the housing 21. The trigger is retained in the housing by means of an annular collar 26 which is biased against the front wall 27 by means of a spring 28 captured in a chamber 29 within the housing 21. The trigger may be direct acting as shown FIG. 2*b* or may act by other means. Trigger 22 has a shaft 30 that extends through the chamber 29 and is integral with the trigger in this example. The collar 26 is sealed against the ingress of water into the chamber 29.

Figure 2C:
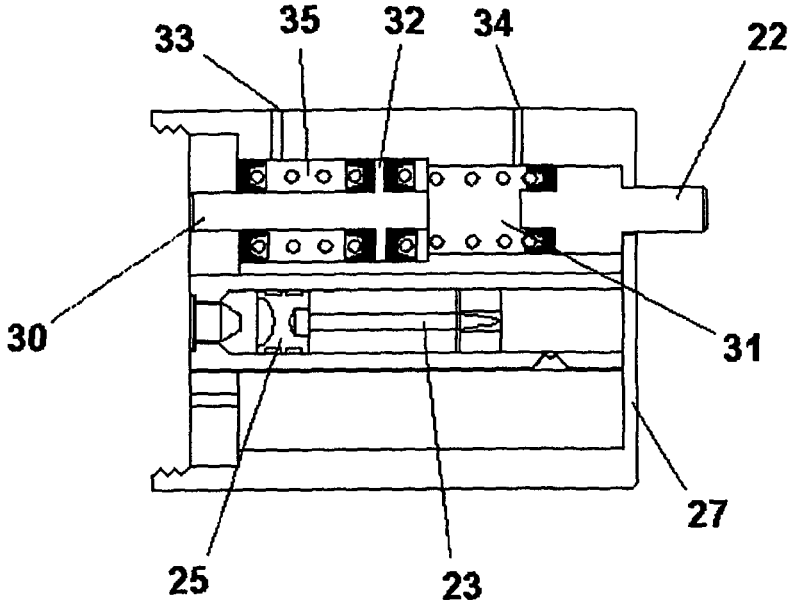

An alternative trigger mechanism is shown in FIG. 2*c*. Here the trigger 22 is retained in a first chamber 31 and biased against the front wall 27 of the housing in a similar manner to the arrangement described above. A shaft 30 passes through a second chamber 35 separated from the first chamber 31 by a piston 32 attached to shaft 30. Air inlets 33 and 34 permit fluid to enter chambers 35 and 31 respectively. This trigger is inoperative in air, as air can be compressed, but when both chambers 31 and 35 are filled with water, as water is not compressible the trigger 22 is rendered operative. When the trigger 22 is pressed, it moves past the port 34 forcing the volume of water in chamber 31 to move the Slave Piston 32 and fire the Grappler in a manner to be explained in more detail below.

The principal components of the breech assembly 20 are release bolt 40, tail plate 41, striker 42, striker spring 43 and striker release sleeve 44. The release bolt 40 is coaxial with and attached to the striker 42. The striker release sleeve 44 is biased in the forward direction by means of spring 45 acting against an annular shoulder 46 on the sleeve 44. The striker 42 and hence the release bolt 40 are biased in the forward direction by means of striker spring 43 acting against an annular shoulder 48 provided on the striker 42.

The striker 42 and spring 43 are surrounded by a striker sleeve 49 which is partially surrounded by the striker release sleeve 44. The striker sleeve 49 accommodates a number of ball bearings 50 in an annular configuration surrounding a front portion of the striker 42. The ball bearings are trapped between the striker 42 and the striker release sleeve 44 which have respective cam surfaces 42*a* and 44*a* whose function will be explained below.

Figure 2D:
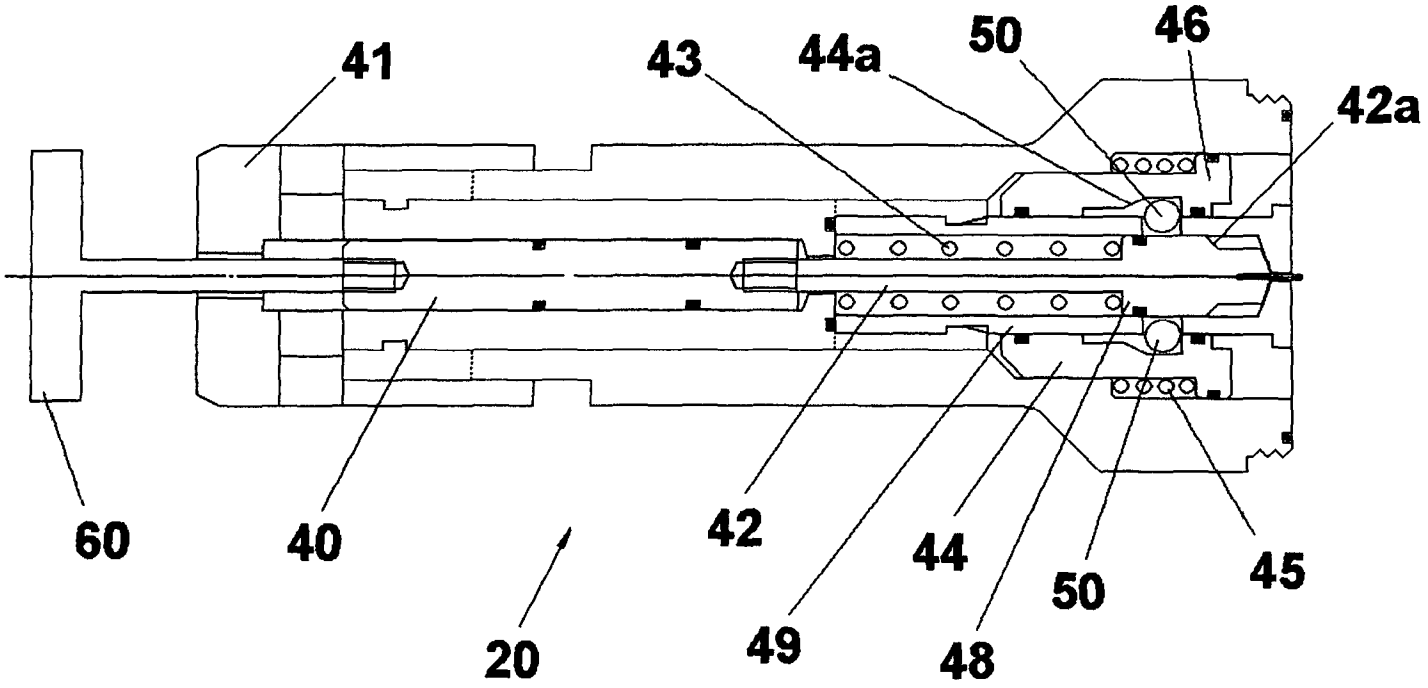
Figure 2E:
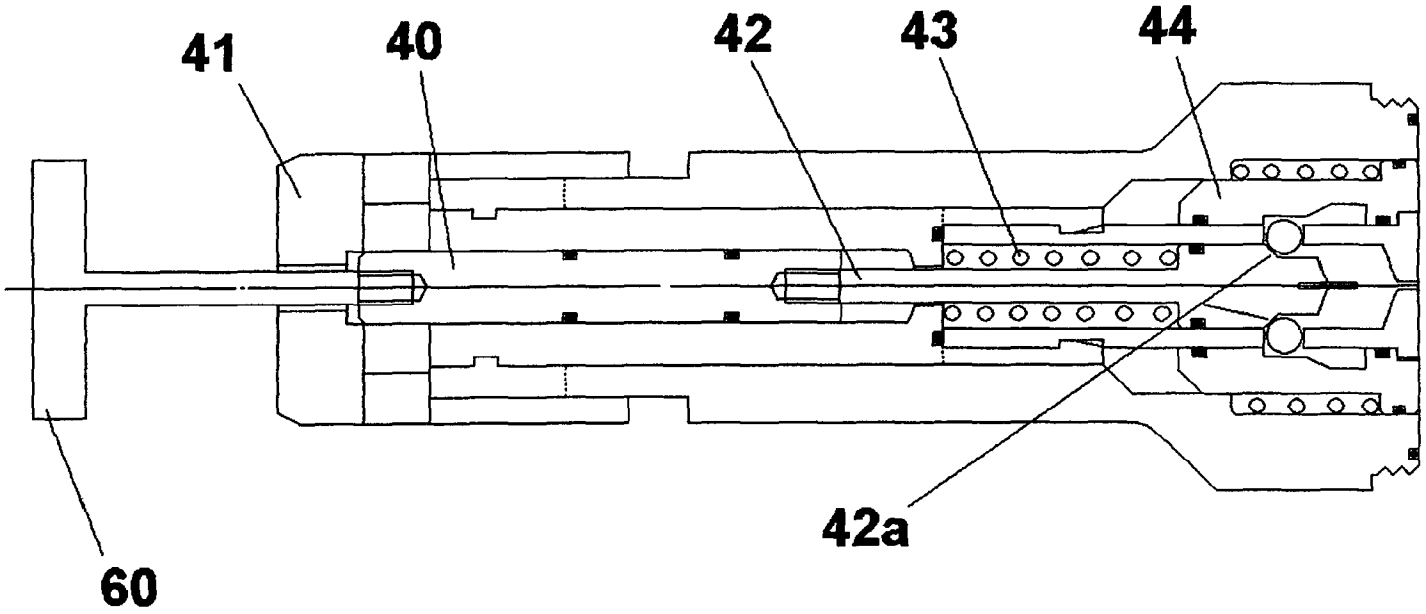
Figure 2F:
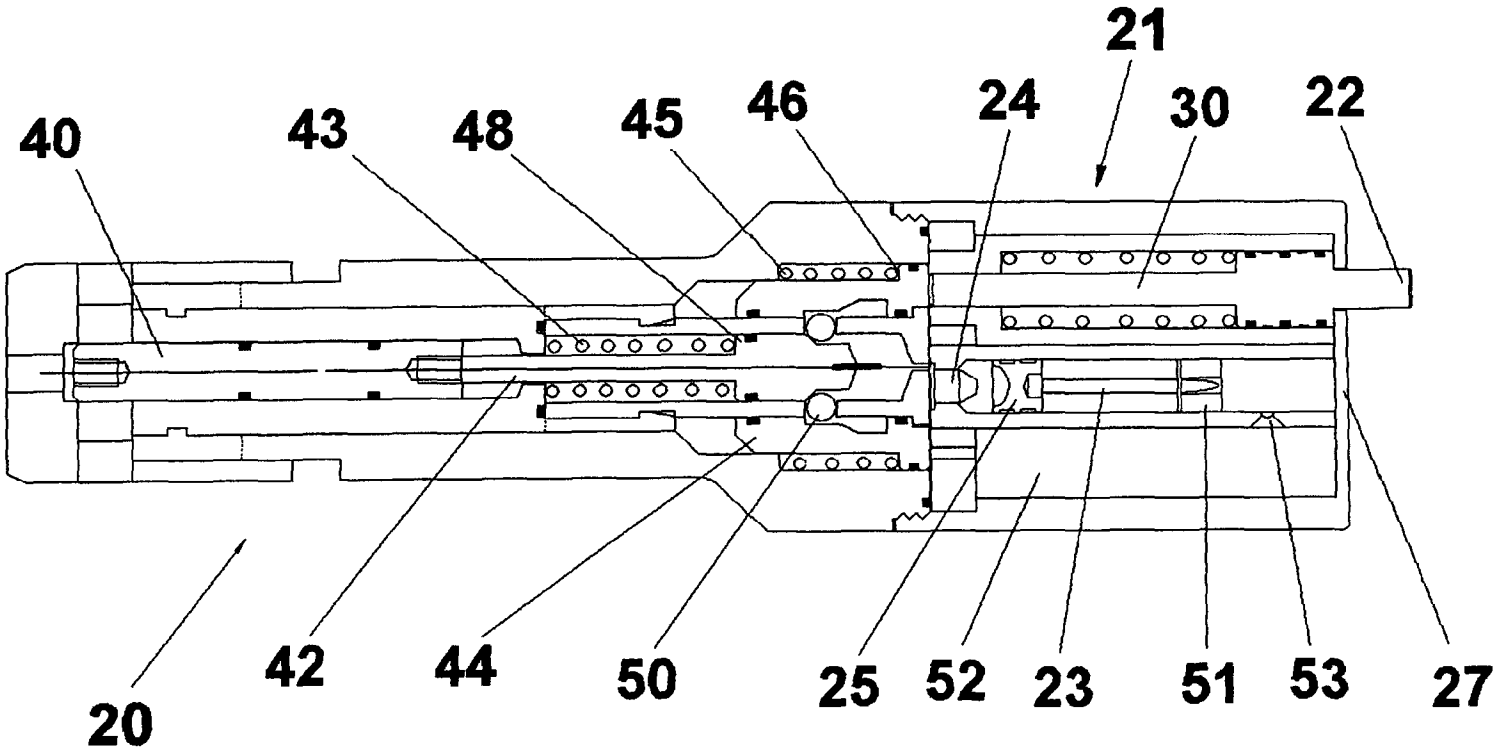

To load the grappler the breech assembly 20 and the barrel assembly 21 are separated from each other. The breech assembly 20 is then armed. In order to do this, starting from the configuration shown in FIG. 2*d*, an arming tool 60 is inserted through a hole in the tail plate 41 into the Breech assembly and connected into the Release Bolt 40, e.g. by means of a screw thread. In the position shown in FIG. 2*d*, the position of the release sleeve is controlled by the ball bearings 50 abutting against the cam surface 44*a* of the release sleeve 44. The Release Bolt 40 is then drawn back using the tool 60, which draws back the striker 42 and compresses the Striker Spring 43. The ball bearings travel down the cam surface 42*a* provided on the striker 42 enabling the striker release sleeve to move forward and lock the striker in the "armed" position shown in FIG. 2*f*.

The cartridge 24 is then inserted into the end of the Barrel and the Barrel Housing 21 is then re-assembled onto the Breech housing 20. The two components may be screwed together.

When the trigger 22 is depressed the Striker Release Sleeve is moved rearwardly allowing the balls 50 to travel outwardly along the cam surface 44*a* of the release sleeve 44. Thus the Striker 42 is allowed to be released, a pin on the end of the striker strikes the rim of the cartridge 24 and the cartridge 24 is fired causing the Piston 25 to drive the Nail 23 through the end face 27 of the Barrel Housing and into the target. A Shunt Buffer 51 then arrests the Piston 25 and the explosive gasses are discharged into an Expansion Chamber 52 through a Discharge Port 53.

The Grappler 6 is now securely attached to the target 4.

Figure 2G:
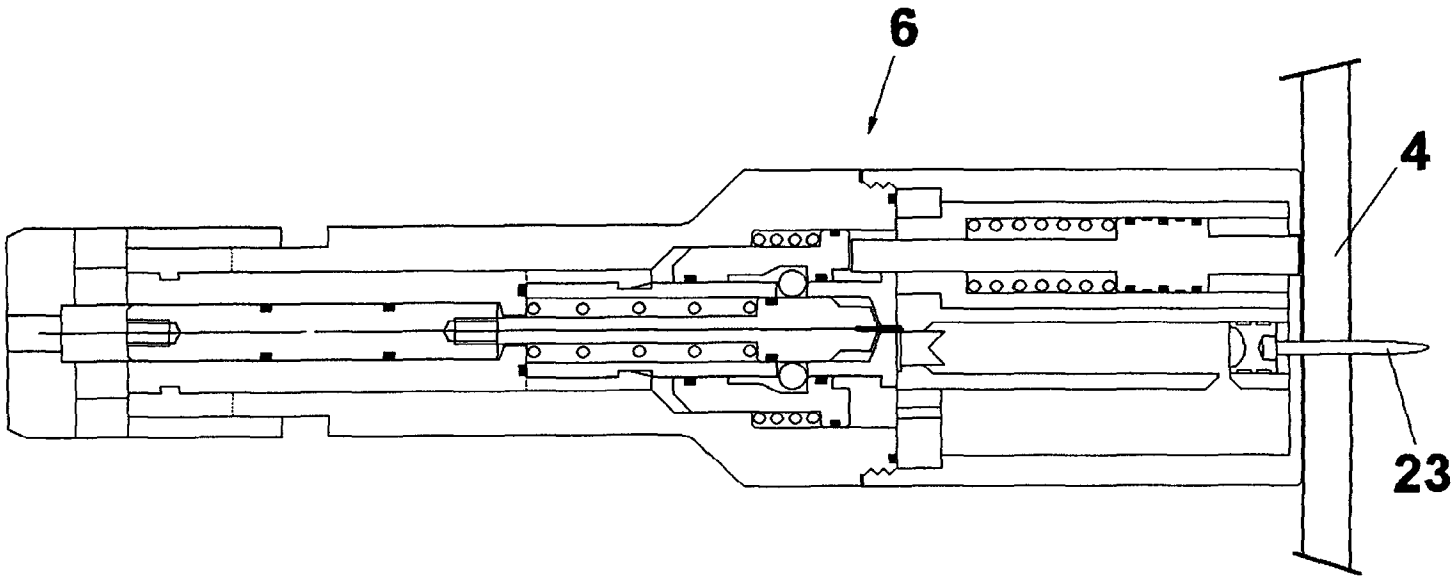

A bungee or other line may be attached to the breech housing 20 so as to be released when the grappler is activated. For example a slot in the cylindrical part of the housing may enable a line to be passed around the release bolt 40 so as to be released when the bolt is in the forward position shown in FIG. 2*g*.

Figure 6:
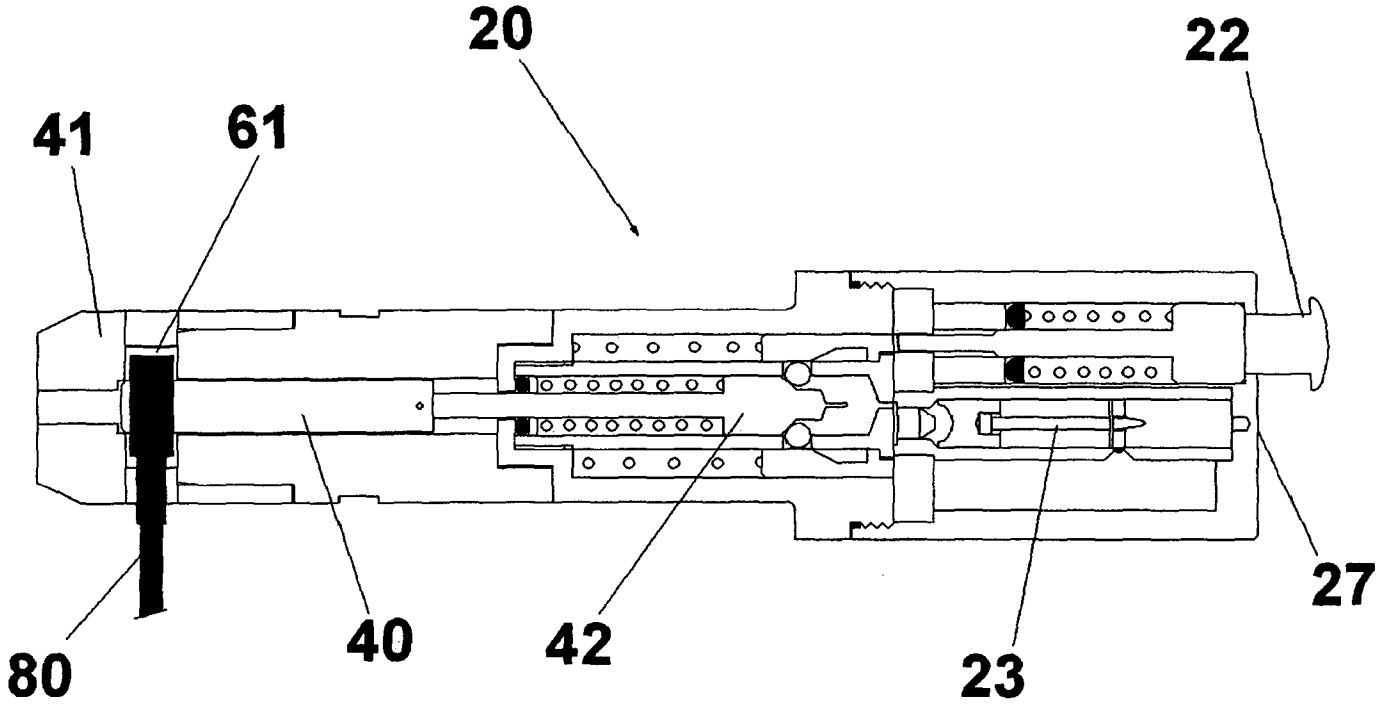
FIG. 6 is a cross sectional view of an alternative grappler in "armed" configuration showing the attachment of a line.
Figure 7:
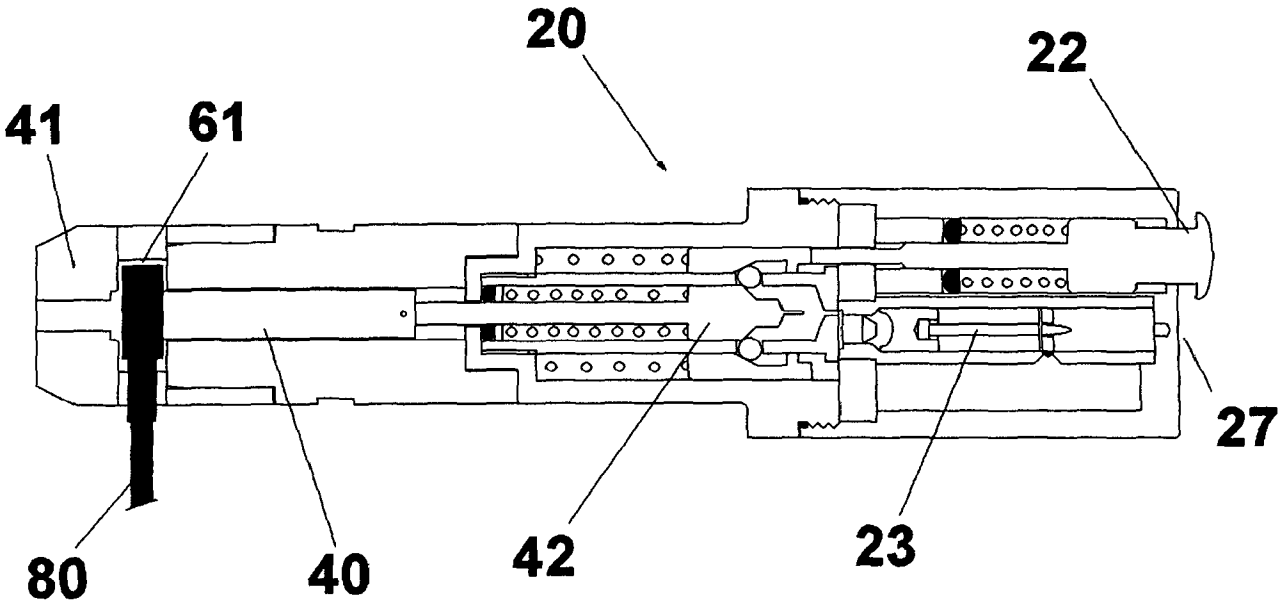
FIG. 7 is a cross sectional view corresponding to FIG. 6 with the trigger moved through part of its travel towards the housing.
Figure 8:
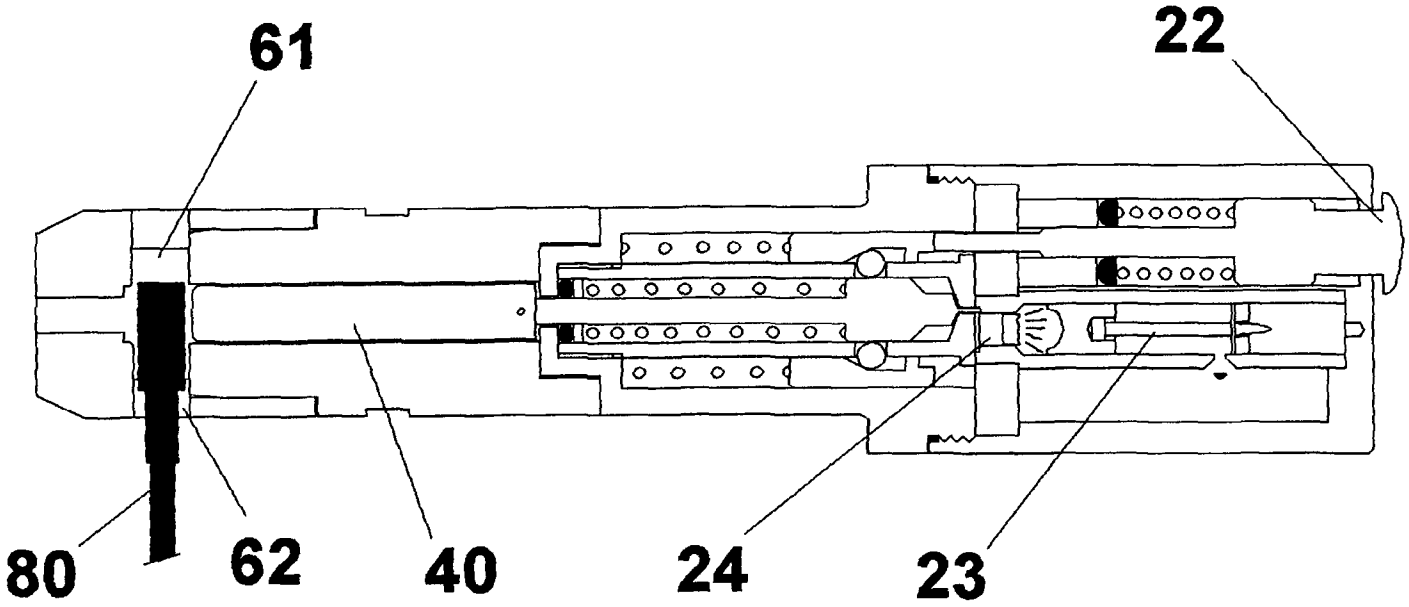
FIG. 8 is a cross sectional view corresponding to FIG. 6 with the trigger fully pressed.

The release of the bungee is illustrated more clearly in FIGS. 6, 7 and 8. These figures show a slightly different embodiment of the invention which operates on the same principle as that described above and for which like parts are indicated by like reference numerals. The trigger 22 has a mushroom shaped head in this example.

Figure 10:
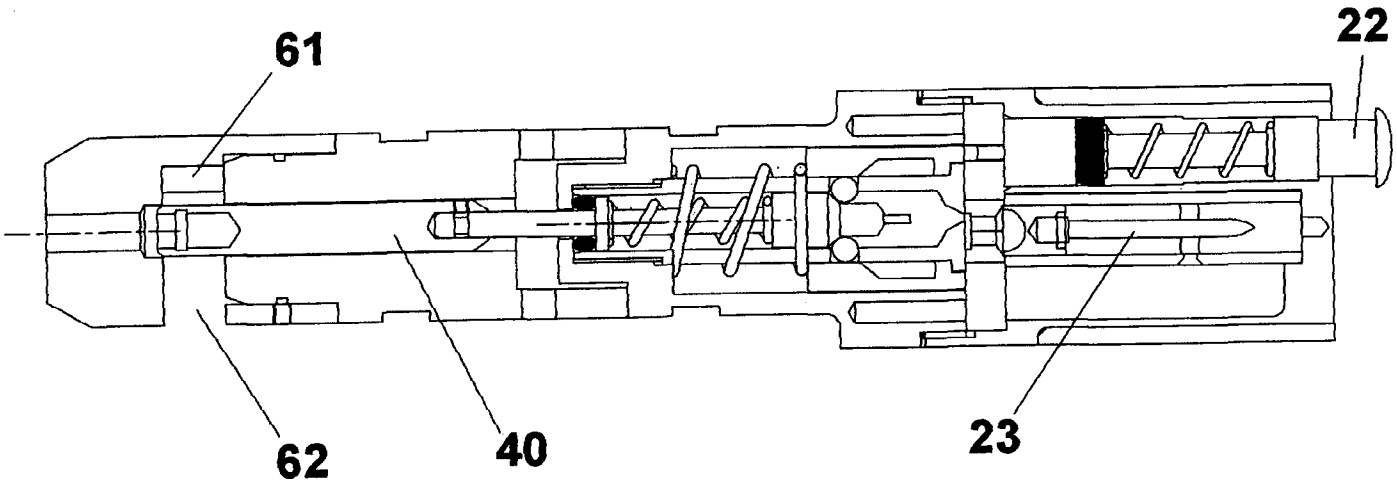
FIG. 10 is a cross sectional view of an alternative device showing more clearly a slot for insertion of the line.

It will be noted that in both embodiments a cylindrical space 61 is present at the back of the breech assembly 20 through which the release bolt 40 passes. A slot or hole 62 shown most clearly in FIG. 10 is provided in the outer wall of the breech assembly 20 permitting access to this space.

Prior to arming the device using the tool 60, a loop 80 of cord or other line may be fed into the space 61 so that when the release bolt is drawn back the bolt 40 passes through the loop 80. FIG. 6 shows a loop 80 inserted into the space 61 and the release bolt drawn back. In this configuration, assuming the loop is closed, the cord is secured to the attachment device and an ROV or other object can be tied to the other end of the cord.

Figure 9:
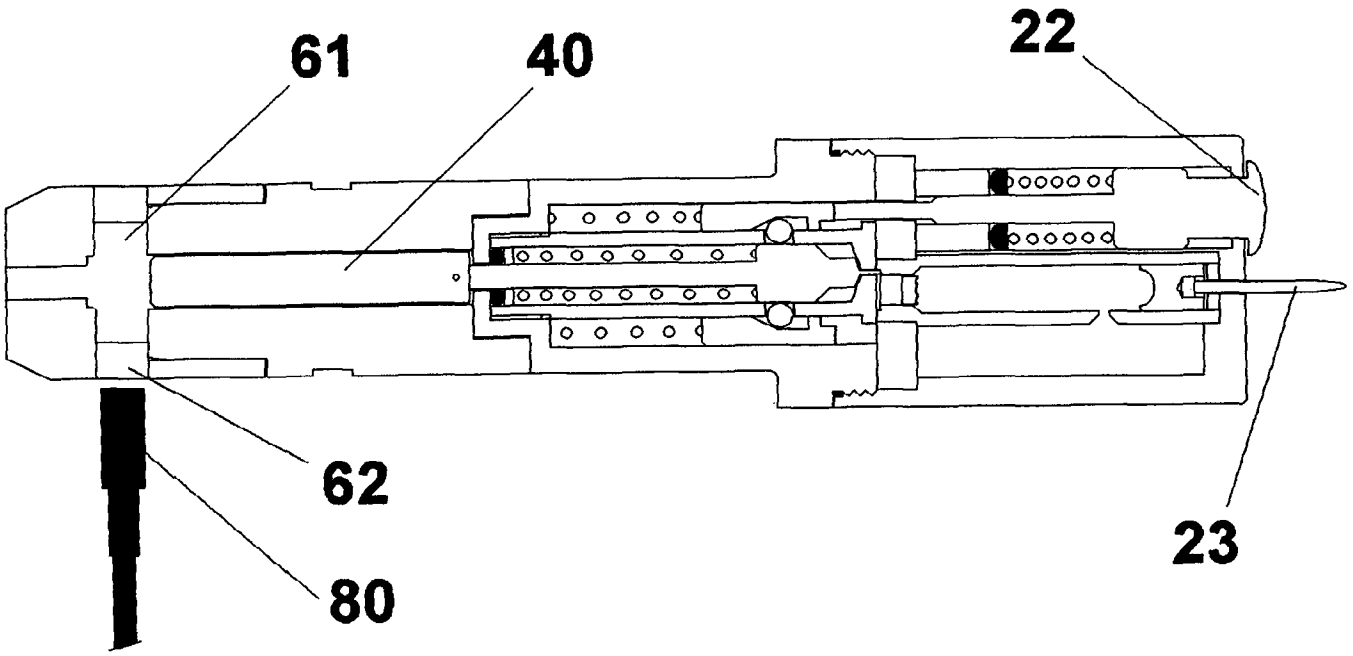
FIG. 9 is a cross sectional view corresponding to FIG. 8 showing the line released.

FIG. 7 shows the trigger 20 partially depressed and it will be seen that the release bolt has begun to travel towards the front of the attachment device, rightward in the figures. FIG. 8 shows the trigger fully depressed. In this configuration the cartridge has been fired and the nail has been driven through the end of the housing. Further, the release bolt has 40 moved out of the space 61 completely. Now the loop 80 is released and can be removed as shown in FIG. 9.

Instead of using a cord loop, something more rigid attached to a loop may be used, such as a hook of rigid material e.g. metal, which might be easier to feed into the space 61.

Disruptor

Generally, the Disruptor 5 consists of a standoff cone, which may be produced in aluminium alloy, a copper charge cone and a charge fill chamber that may be produced in aluminium alloy. These items are hermetically sealed and able to operate up to a depth of 300 meters without impairment of operation. On the rear of the unit is a removable end cap that may be produced in high-density polyethylene or other material and a retainer to hold the detonator. The Disruptor may be filled with any proprietary plastic explosive such as PE4/C4.

Figure 3A:
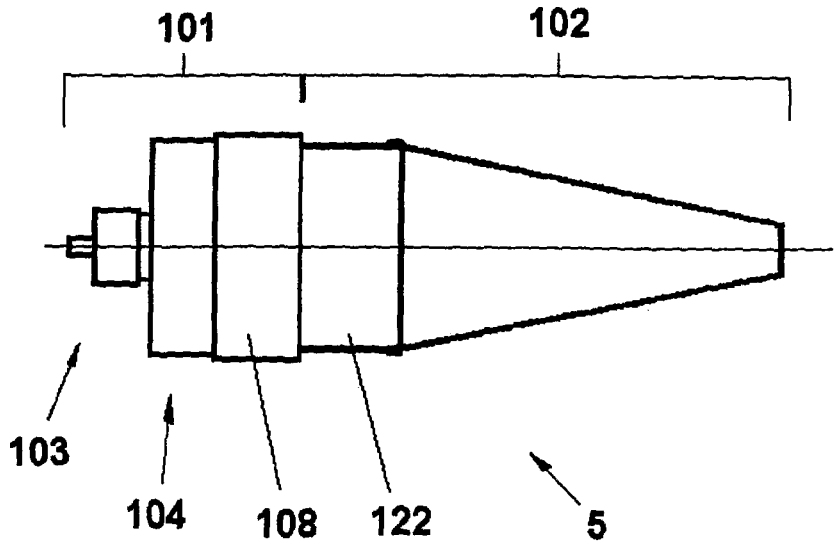
Figure 3B:
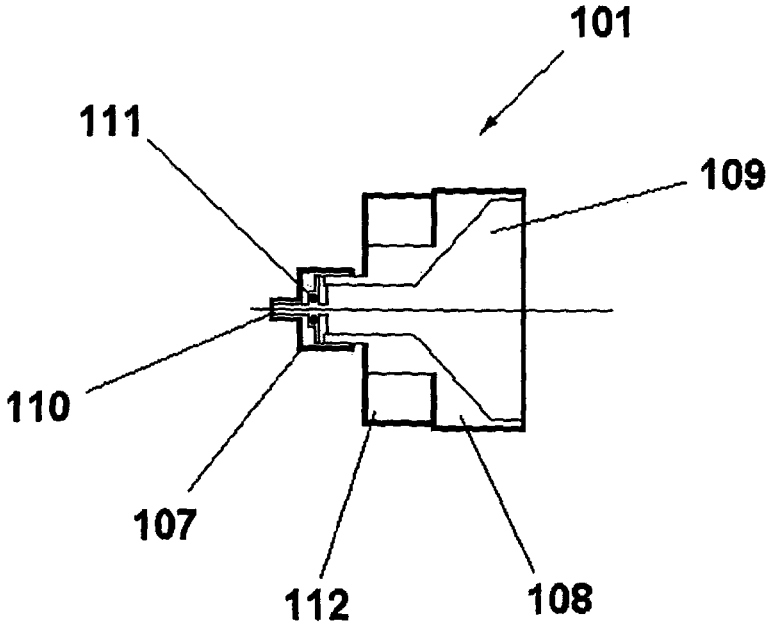
Figure 3C:
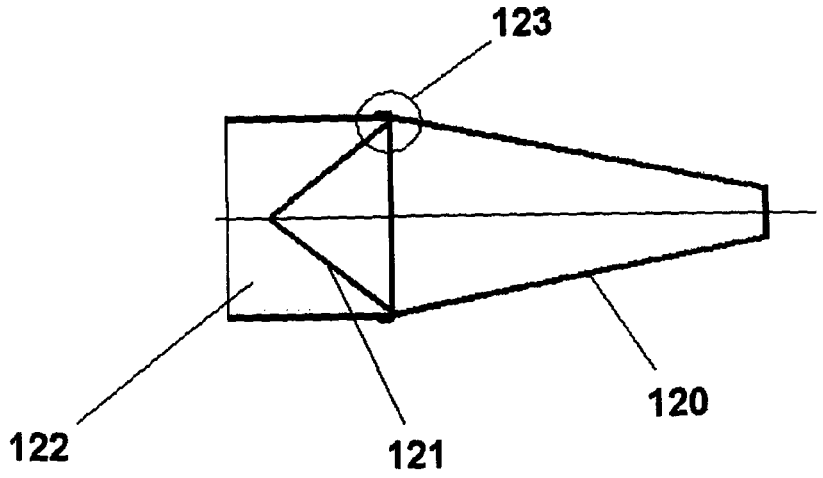

Referring now to FIGS. 3*a* to 3*c*, the Disruptor 5 is a self-fill shaped charge demolition device, the main components of which are the Charge Cap Assembly 101 and front section 102. The charge cap assembly comprises a detonator retention system 103 and Buoyancy Compensation 104. The Front Section 102 comprises a main energetic Chamber 105 and the Charge-Shaping Cone 106. These units may be separated to enable filling with PE4/C4 energetic material or similar.

To load the Disruptor 5 the Charge Cap Assembly 101 is first removed from the Front Section 102 and Detonator Retaining Cap 107 is removed from the Charge Cap 108. It will be noted from FIG. 3*b* that the charge cap provides a chamber 109 having a conical shape. PE4/C4 or other suitable energetic is formed/inserted into the Conical Chamber 109 in the Cap 108. A suitable detonator compatible with the plastic tube initiation system is positioned into a hole 110 in the Detonator Retaining Cap 107. This is typically a cylindrical object. A Rubber Retaining Ring 111 is slipped over the detonator to hold it in place. One or more Buoyancy Rings 112 are fixed into position on the Charge Cap 108. The Detonator Retaining Cap 107, with detonator in position, is then screwed into place on the charge cap 108 and the Rubber Retaining Ring 111 now safely retains the detonator in position.

The Front Section 102 consists of the Standoff Cone 120 which positions the Disruptor 5 at the optimum distance for maximum penetration (approx twice the Charge Chamber 109 maximum diameter), the copper Charge Shaping Cone 121, which forms the energetic to the correct angle and is of optimum mass for jet formation (approximately 2% Charge Chamber diameter) and the Charge Chamber 122 which holds a measured amount of energetic. These three components 120, 121, 122 are machined to achieve maximum contact at their joining indicated at 123 such that after hermetically bonding with suitable adhesive they can withstand pressures at depth.

The Charge Chamber 122 is also filled with energetic material. The Front Section 102 and the Charge Cap Assembly 101 are now joined together. They may be joined by means of a screw thread. Thus the charge chamber 122 and the charge cap 108 form a single chamber with forward and rear surfaces which both have a rearward facing conical shape.

The Disruptor 5 is now prepared and ready.

When the material within the conical cap 109 and charge chamber 122 is detonated, an explosion occurs which causes the charge shaping cone to invert and a hypersonic jet is forced out of the end of the front section 102. The diameter of the flat end face of the section 102 defines the diameter of the resulting jet stream. The charge shaping cone forms a slug under the surrounding pressure on it and is forced out of the front section behind the jet stream.

Hand-Held System

The Hand-Held system, which may be used in or out of water and may be hand held or deployed using the articulated arm of a ROV consists of a Grappler 6, which is restrained in a sleeve 130 using a screw 131 or other device and connected to a handle 132, which may be articulated, and a Manacle Clamp 133 or other similar device suitable to restrain a Disruptor 5 so that the faces of both devices (i.e. the Trigger Face on the grappler 6 and the nose of the Standoff Cone 120 of the Disruptor 5) are generally coincident. As shown the end of the trigger 122 is slightly in front of the nose of the standoff cone. The plastic tube 7 from the detonator initiation system is restrained in a Strain Relief Clip 134.

Figure 4A:
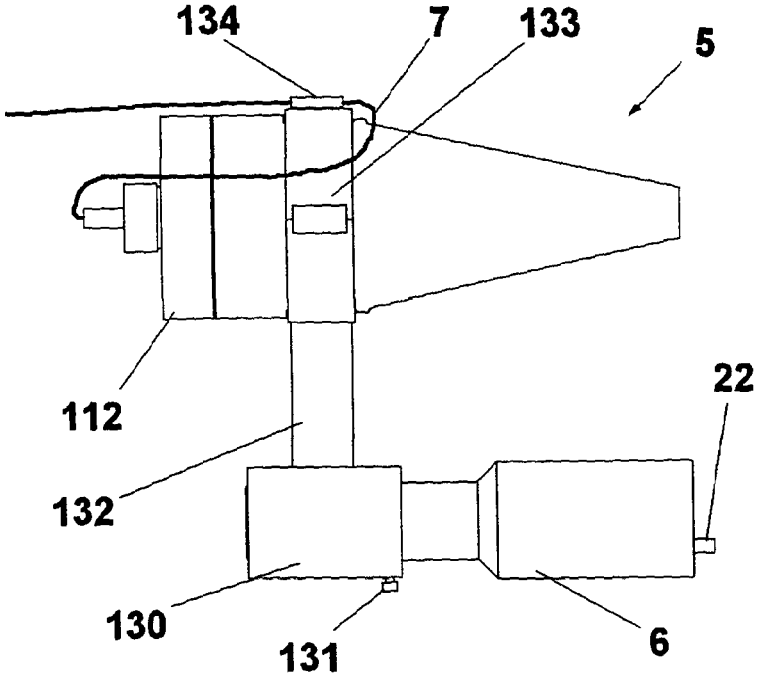
Figure 4B:
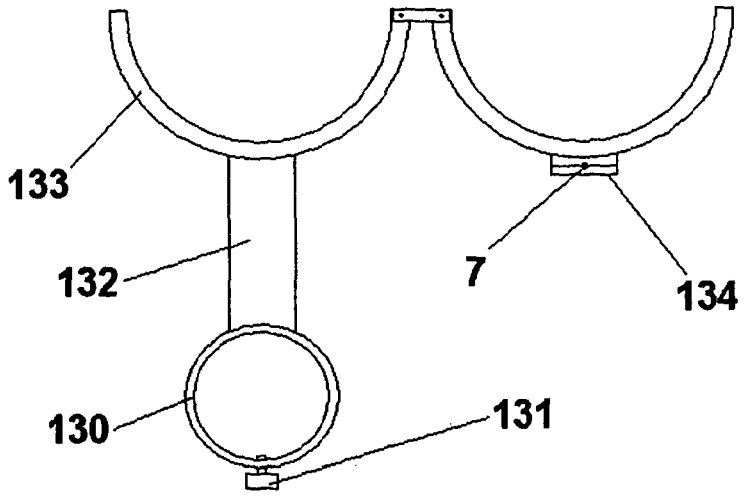

A detailed sketch of a suitable handle assembly is shown in FIG. 4*b*. Manacle clamp 133 is shown hinged open, attached to the Handle (FIG. 4*b*-2) which may be of articulated construction to enable adjustment of the direction of the Disruptor after attachment of the Grappler to the Target. For example the handle may enable rotation of the disruptor with respect to the grappler about the axis of the handle. The sleeve 130 that receives the Grappler 6 is appended with a Screw 131 or other device to lock the Grappler 6 into position relative to the Disruptor 5 and the plastic tube 7 is shown in the Strain Relief Clip 134.

The Buoyancy Compensation Rings 112 ensure that, in water, the unit is slightly positively buoyant such that it would not adversely affect a swimmer or diver but if inadvertently released it would slowly drift to the surface and thus recoverable and not present a possible hazard to fishermen.

Cowl

Figure 5A:
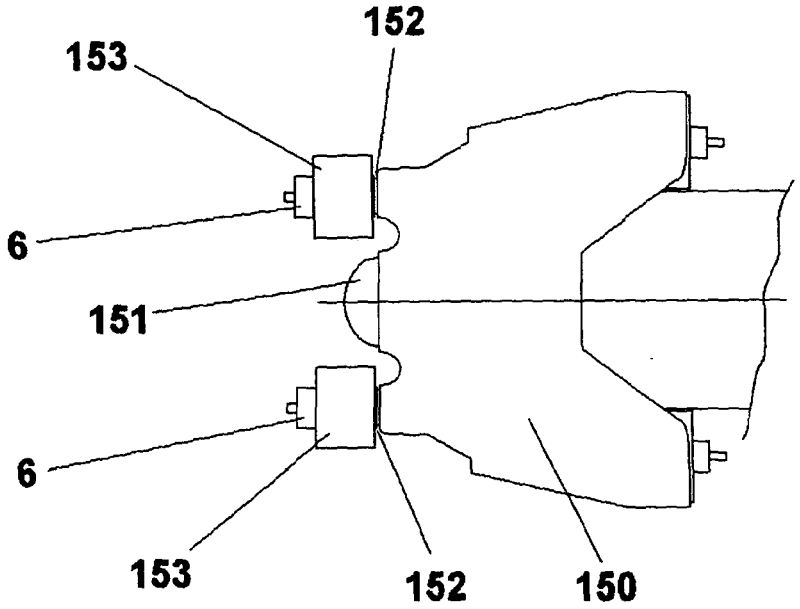
Figure 5B:
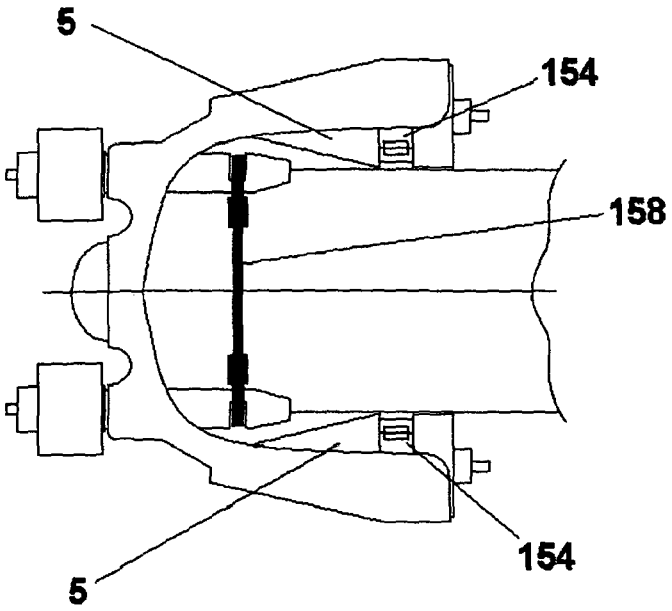
Figure 5C:
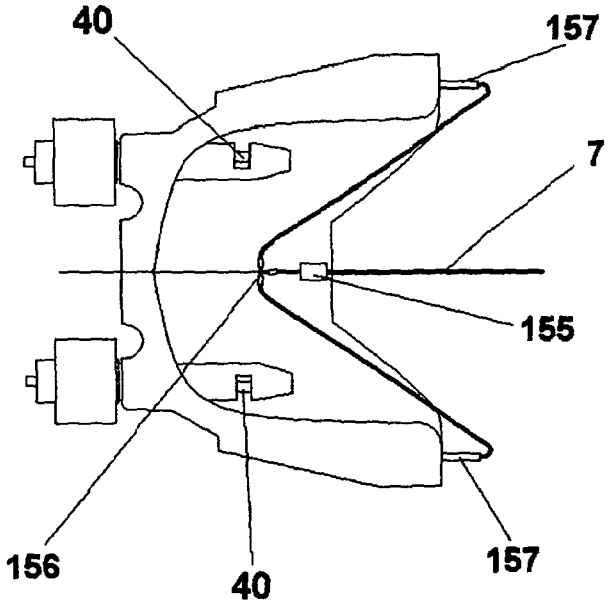

The Cowl is shown in FIGS. 5*a* to 5*c* and is of hydro dynamic shape to minimise drag through the water and is designed such that it interfaces with other proprietary ROV's and Sea Scooters or other vehicles and is compensated to achieve neutral buoyancy. As such it is in the shape of a generally conical collar. The cowl consists of a moulding of reinforced glass fibre or similar material with holders for the Grapplers 6 (usually two but at least one), manacle restraints for the Disruptors 5 and other clips and restraints to attach the proprietary plastic tube detonator initiation system 7.

The Cowl is designed to e disposable. It is manufactured from glass reinforced fiberglass or other material in a hydrodynamic shape and such that it interfaces with the nose cone 151 of an ROV or Sea Scooter. It may be designed in the form of a hood completely covering the nose of the vehicle.

FIG. 5*a* shows a cowl 150 fitted with two Grapplers 6, which are slid into, and retained by, two sleeves 152 bonded into the Cowl 150. The Grapplers 6 are fitted with Buoyancy Compensation Rings and Trim Weights 153 to achieve neutral buoyancy.

It is fitted with two Manacle Clips 154 or other device to attach two Disruptors 5.

It is also fitted with Strain Relief Clip and other Clips to fix the proprietary plastic tube detonator initiation system 7 which attach the Dispensing Reel 8 through a Tee Piece Joiner 156 to Detonators 157 in the Disruptors 5 (not visible in FIG. 5*c*).

After loading with Grapplers 6 and (filled) Disruptors 5 the Cowl 150 is neutral buoyant, this renders the cowl's air-weight invisible to the ROV in water. Trim weights are loaded to compensate for differing salinity of seawater.

The Cowl is slid onto the front of the ROV and a bespoke Bungee Cord 158 is clipped on underneath joining both Release Bolts 40 on the Grapplers 6.

The Cowl 150 is now ready for launch.

When a target 4 is confirmed the ROV 9 is driven at the target 4 to impact the Triggers 22 on the Grapplers 6. If either or both Grapplers 6 are fired the cowl 150 will detach from the ROV as a result of the bungee 158 being released from one or both of the grapplers. As the Cowl 150 is neutrally buoyant it will remain with its attitude stable until the Disruptors 5 are initiated.

The ROV can then be moved to a safe distance and the Target 4 destroyed.

Alternative Grapplers

Some further alternative forms of grappler suitable for use in the systems described above are shown in FIGS. 11 and 12.

Figure 11:
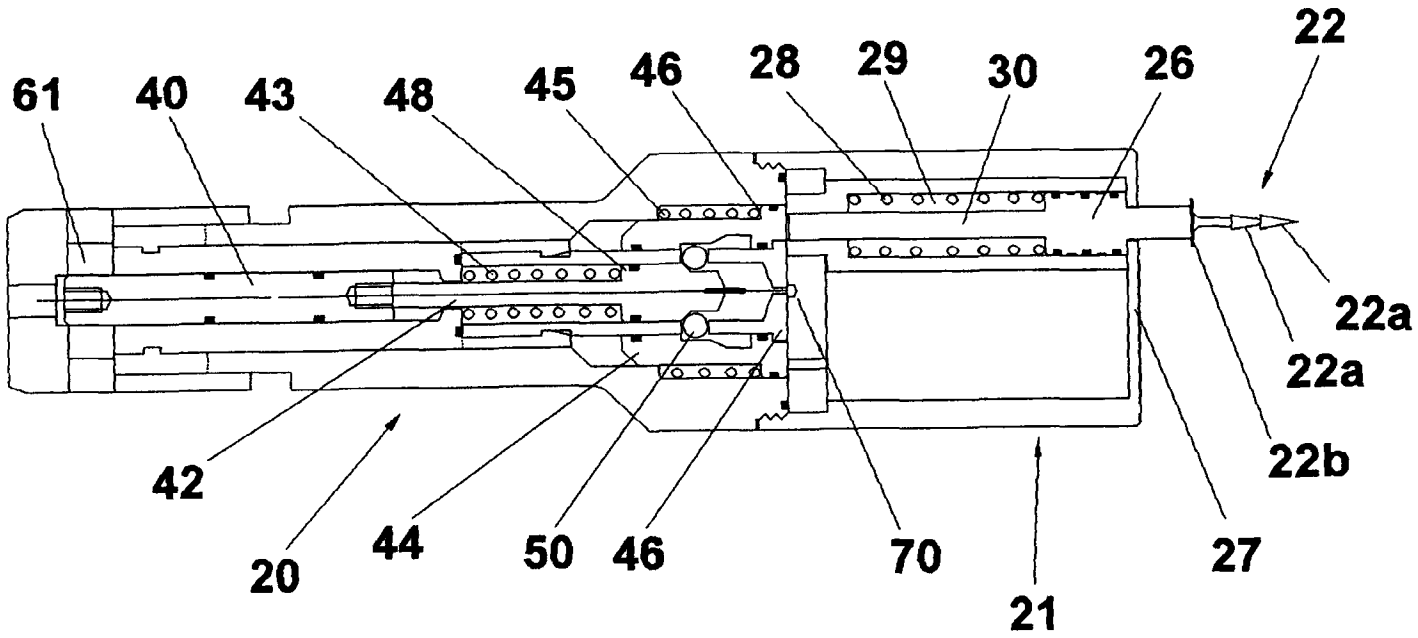
FIG. 11 is a cross sectional view of an alternative device in which the trigger also acts as a fastener.

In the example shown in FIG. 11 the trigger also serves as a fastener, thereby avoiding the need for the nail and the use of explosive to drive the nail.

The operation of the device shown in FIG. 11 is similar to those described above in that the trigger is pushed rearward towards the front face of the device which results in the release bolt being pushed forward thereby enabling the release of a cord loop or other item retained by the release bolt. Like parts in the respective examples are given like reference numerals.

Thus, as with the previous examples, the trigger mechanism is contained in the barrel assembly 21. The trigger 22 is designed such that it is sealed to prevent water ingress into the housing. The trigger is retained in the housing by means of an annular collar 26 which is biased against the front wall 27 by means of a spring 28 captured in a chamber 29 within the housing 21. The trigger may be direct acting or may act by other means. Trigger 22 has a shaft 30 that extends through the chamber 29 and is integral with the shaft in this example. The collar 26 is sealed against the ingress of water into the chamber 29.

In contrast to the previous examples, the trigger itself is a not a simple protrusion but is in the shape of a harpoon with barbs 22*a* designed so that once the trigger penetrates the surface of a target the barbs obstruct its removal. Other shapes that resist removal after insertion are possible. This device is designed for targets with thin or weak walls or skins that might crumble or be otherwise damaged by the impact of a fastener driven under explosive force. Thus a possible design of faster is one with an "umbrella" head that opens once the fastener has penetrated the wall or skin of the target. Other possible fastener designs will occur to those skilled in the art. Such fasteners are also suitable to be driven in the manner of the nails of the previous examples.

As with the earlier examples of attachment device, when the trigger 22 is depressed the Striker Release Sleeve 44 is moved rearwardly allowing the balls 50 to travel outwardly along the cam surface 44*a* of the release sleeve 44. Thus the Striker 42 is allowed to be released. This moves forwardly taking with it the release bolt 40. The forward movement of the release bolt 40 will release anything the bolt has trapped in the space 61 at the rear of the breech housing.

A blast plate 70 takes the impact of the striker 42 as it is moved forward under the force of spring 43. This is provided with a dimple to guide the end of the striker 42 and ensure that the striker does not slip or become damaged on impact with the blast plate.

It will be appreciated that the device shown in FIG. 11 could be provided with multiple trigger/fasteners 22.

The trigger/fastener 22 shown in FIG. 11 has a collar 22*b* on the outside of the device housing which abuts against the surface of the housing when the release bolt 40 has moved forward out of the space 61. At this point further pressure on the fastener will cause it to be driven into the target rather than the device housing.

Indeed in all of the foregoing embodiments multiple triggers could be provided. This might be useful in turbulent conditions where accurate positioning to actuate one relatively small trigger is difficult.

For the same reason the trigger might be provided with a large surface area for impact with the target, such as a larger mushroom shape than that shown in FIGS. 6 to 10.

Figure 12:
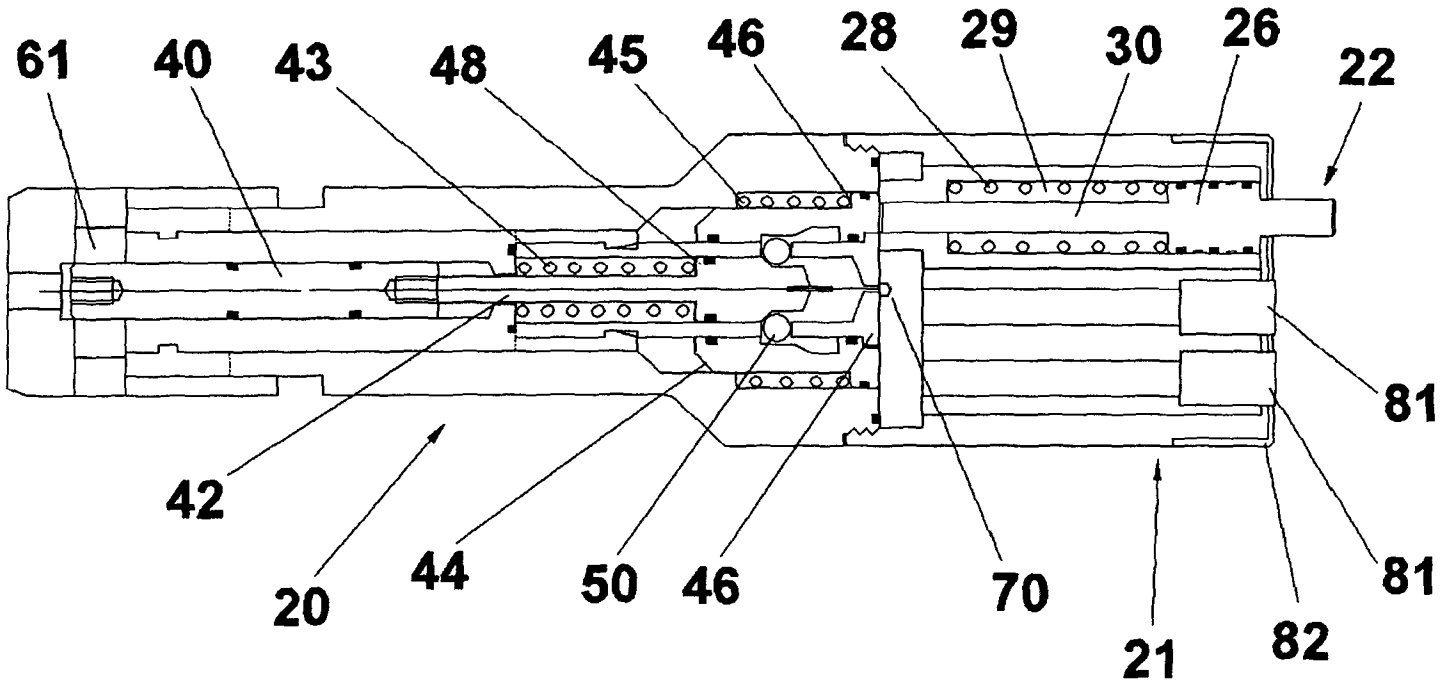
FIG. 12 is a cross sectional view of an alternative device in which magnets are used as fasteners.

The embodiment of attachment/release device shown in FIG. 12 comprises multiple fasteners in the form of magnets 80. As with the device shown in FIG. 11, this version has no nails and no cartridge detonation system to drive the nails. In this device the trigger is a simple button. When the button is pressed towards the front of the housing this initiates a series of operations as with the device shown in FIG. 11 resulting in the forward movement of the release bolt 40 out of the space 61 at the rear of the device.

Figure 13:
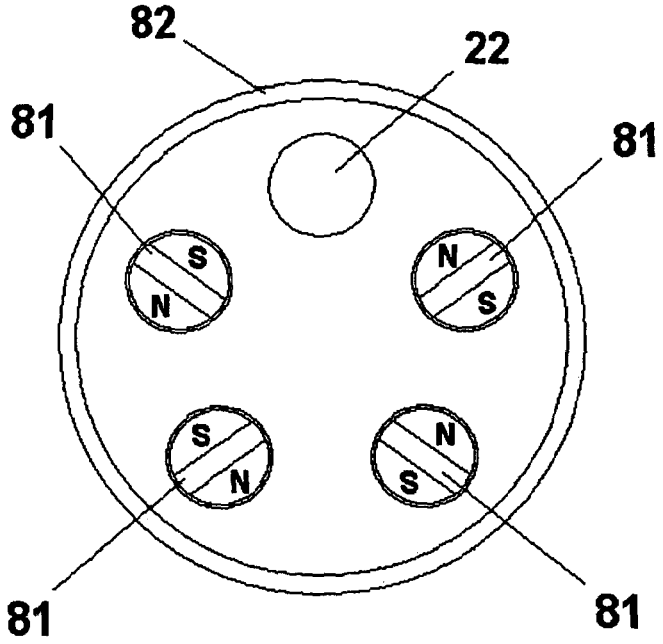
FIG. 13 is a front elevation of the device shown in FIG. 12.

With the trigger fully depressed the surface of the trigger is flush with the front face of the device as in the device shown in FIG. 2. The magnets are then brought into contact with the surface of the target and become attached to it. Multiple magnets 80 may be provided. These may for example be arranged radially such that the magnetic flux is in a closed loop around the face of the device. An example of such an arrangement is shown in FIG. 13. Here the magnets are arranged in a circle with opposite poles facing each other around the circle.

A magnetic shield 82 is arranged around the front face and forward cylindrical surface. The purpose of this is to absorb any stray magnetic flux that may cause interference with the ROV navigation system (such as magnetic compass).

It will be appreciated that the various embodiments of attachment/release devices described above have many components in common and this minimises the tooling required to produce them all.

The system described above has a number of advantages including the following:

It enables the provision of an EOD disruptor/demolition device/assembly that is cost-effective, compact and easy to operate and can be attached by manual or remote means in one expedient and safe manoeuvre.

A disposable EOD disruptor/demolition assembly as described above can be matched to various applications.

The EOD disruptor/demolition device can be set off in sequence or simultaneously with other devices.

The assemblies of attachment and disruptor enable a disruptor/demolition method that is less susceptible to stray electromagnetic and electrostatic energy than current methods.

The device that can be quickly deployed and thus reduce the time an EOD technician must spend in the vicinity of the ordnance.

The device has the capability for multiple option firing.

Thanks to the grapplers a disruptor can be attached quickly and easily and does not require additional restraint.

A grappler disruptor assembly is capable of attaching to a multiplicity of materials including but not exclusively steel, fibreglass, wood, plastic, brickwork and concrete. It can attach irrespective of surface condition including but not exclusively seaweed, slime, barnacles, rust, paint, tar, and plastic coatings.

The disruptor is self-fill such that it is completely inert during transportation (the explosive being added by the user at time of deployment).

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is limited only by the scope of the attached claims, including the full range of equivalency to which each element thereof is entitled.

The invention claimed is:

1. An attachment device for attachment to a target, the device comprising:
   - a housing having a front face which abuts against the target in use,
   - one or more fasteners,
   - a drive mechanism for driving the fastener(s) from a first position within the housing to a second position protruding from the front face of the housing, and
   - a trigger mechanism for triggering activation of the drive mechanism comprising a trigger extending from the front face of the housing and connected to the drive mechanism such that pressure on the trigger towards the front face of the housing causes activation of the drive mechanism to drive the fastener(s) from the first position to the second position, wherein the trigger mechanism is non-electrically operatively connected to the drive mechanism.

2. An attachment device as claimed in claim 1 in which the drive mechanism is arranged to detonate a cartridge containing explosive material to cause the fastener(s) to be driven to the second position.

3. An attachment device as claimed in claim 1 in which the drive mechanism includes a striker within the housing which is forced in a direction towards the front face in response to pressure on the trigger from outside the housing towards the front face.

4. An attachment device as claimed in claim 3 in which the drive mechanism is arranged to detonate a cartridge containing explosive material to cause the fastener(s) to be driven to the second position and the striker is arranged to strike the cartridge and thereby detonate the explosive.

5. An attachment device as claimed in claim 1 comprising a plurality of fasteners in which each fastener is an elongate member having a laterally extending rear portion which is captured within the housing when the fastener is in the second position.

6. An attachment device according to claim 5 in which each fastener has a generally cylindrical forward portion and the laterally extending portion provides an annular shoulder to abut against a portion of the interior of the housing.

7. A device as claimed in claim 1 in which each of the one or more fastener is shaped to resist its removal from an object after insertion.

8. A device as claimed in claim 1 in which each of the one or more fastener comprises barbs to resist its removal from an object after insertion.

9. A device as claimed in claim 1 in which each of the one or more fastener is harpoon shaped.

10. An attachment device as claimed in claim 1 comprising a fastening mechanism having fastened and unfastened configurations in which the activation of the trigger causes the fastening mechanism to move from the fastened configuration to the unfastened configuration.

11. An attachment device as claimed in claim 10 in which the fastening mechanism comprises a member movable in response to activation of the trigger from the closed position to an open position.

12. An attachment device as claimed in claim 11 wherein in the closed position the member bridges an opening in the housing and in the open position the member is at least partially retracted from the opening.

13. An attachment device as claimed in claim 11 wherein the member comprises a bolt.

14. An attachment device as claimed in claim 10 in which the fastening mechanism comprises a member movable in response to activation of the trigger from a closed position to an open position, wherein the member is driven by the drive mechanism.

15. An attachment device as claimed in claim 1 having attached thereto one or more secondary devices for attachment to the target.

16. An assembly as claimed in claim 15 comprising a handle joining the device and the secondary device(s).

17. An assembly as claimed in claim 15 comprising multiple attachment devices and/or multiple releasable fastening devices.

18. As assembly as claimed in claim 15 including multiple attachment devices and/or multiple releasable fastening devices and multiple secondary devices.

19. An assembly as claimed in claim 15 in which the one or more secondary devices comprise one or more disruptors.

20. An assembly as claimed in claim 19 in which the one or each disruptor has a generally cone shaped forward section which is fixed with respect to the device such that the trigger of the device is level with or slightly forward of the front of the cone-shaped section of the disruptor(s).

21. An assembly as claimed in claim 20 in which the disruptor(s) and device(s) are fixed in such as way as to permit rotation of the disruptors with respect to the device(s).

22. An assembly as claimed in claim 20 comprising multiple devices and multiple disruptors arranged in parallel around the collar or cowl.

23. An assembly as claimed in claim 19 comprising a collar or cowl to which the device(s) and the one or more disruptors are attached.

24. An assembly as claimed in claim 15 including one or more buoyancy aids whereby to render the overall density of the assembly higher than that of water.

25. A disruption system comprising an assembly as claimed in 15 and a detonation line for attachment to the or each disruptor.

26. A disruption system as claimed in claim 25 comprising a dispenser for the detonation line.

27. A disruption system as claimed in claim 25 including a floating device supporting the dispenser.

28. A disruption system as claimed in claim 25 in which the detonation line comprises a tube filled with explosive material.

29. A disruption system as claimed in any of claim 25 further comprising a detonator initiation device.

30. A disruption system as claimed in claim 29 in which the detonator initiation device is remotely operable.

* * * * *